United States Patent [19]

Nolan

[11] 4,252,068

[45] Feb. 24, 1981

[54] CAST DRAFT SILL

[75] Inventor: Harry E. Nolan, Williamsville, N.Y.

[73] Assignee: Dresser Industries, Inc., Dallas, Tex.

[21] Appl. No.: 71,422

[22] Filed: Aug. 30, 1979

[51] Int. Cl.[3] ..... B61F 1/00; B61F 5/16

[52] U.S. Cl. ..... 105/420; 105/199 C; 105/415; 213/51; 213/57

[58] Field of Search ..... 105/199 C, 413–421; 213/7, 8, 51, 56, 57

[56] References Cited

U.S. PATENT DOCUMENTS

| | | | |
|---|---|---|---|
| 2,646,010 | 7/1953 | Nystrom | 105/420 |
| 3,664,269 | 5/1972 | Fillion | 105/199 C |
| 3,677,198 | 7/1972 | Yang et al. | 105/420 |
| 3,973,681 | 8/1976 | Martin et al. | 213/8 |
| 4,056,065 | 11/1977 | Fiegl et al. | 105/199 C |
| 4,128,062 | 12/1978 | Roberts | 105/420 |

OTHER PUBLICATIONS

1970 Car & Locomotive Cyclopedia of American Practice, Second Edition, pp. 334–339, 556, 557 586, 587.

*Primary Examiner*—Randolph A. Reese

*Attorney, Agent, or Firm*—J. N. Hazelwood; B. E. Deutsch

[57] ABSTRACT

A unitary cast draft sill for welding to the center sill of a railroad car comprises a unitary cast structure with the following elements and features: A horizontal top wall has a pair of side walls depending therefrom with a bottom portion having flanges extending horizontally outward from the side walls. A vertical inboard end wall joins the bottom portion, the side walls and the top wall and has a transition element extending from the inboard side portion thereof to telescopically enter adjacent portions of a railroad car center sill. A center filler plate pocket is formed by the inboard end wall, portions of the side walls and the top wall and an internal vertical wall spaced in the outboard direction from the inboard end wall to form a cavity opening at the bottom portion to accept and mount a center filler plate in welded relation. Rear draft lugs are formed at the outboard side of the internal vertical wall and adjoin the side walls. On the outboard end portion of the cast draft sill, it has a horizontal top striker above the coupler shank opening, a carrier to vertically support the coupler shank and a key slot through the side walls for a coupler draft key.

22 Claims, 8 Drawing Figures

CAST DRAFT SILL

TECHNICAL FIELD

This invention is related to cast draft sill structures for railroad cars. More specifically, the invention pertains to a unitary cast draft sill structure that has a transition element including a structural splice or a fish-tail plate for mounting in a telescopic fashion with the railroad car center sill, a pocket for mounting a center filler plate, draft lugs at opposite ends of a draft gear pocket, a striker plate, a coupler carrier, and a draft key slot.

BACKGROUND OF THE INVENTION

Prior art cast draft sills are constructed to replace many of the mechanical elements in a draft sill structure that are necessary to transmit the draft and buff forces from the railroad car coupler to the car's center sill. However, these prior art cast draft sills are not constructed so that the center plate can be replaced without either replacing the entire cast draft sill or replacing the center plate with a conventional fabricated style bolt-on center plate. Also the prior cast draft sills are sometimes fabricated in segments with one segment combining the striker, front draft lug and key slot and the other segment combining a center brace, rear draft lugs, center plate and king pin mounting hole. An obvious difficulty with the separate prior art castings is that they must be precisionally aligned and welded to the railroad car center sill. Another not so obvious problem arises when considering distribution of the buff and draft forces through the structure from the coupler to the railroad car's center sill. In this respect, the load carrying members of the structure must be designed to distribute these forces and avoid extreme stress concentrations that inherently shorten the useful life of the railroad car.

Those prior art cast draft sills which incorporate the center plate and king pin hole into the unitary structure must provide substantial bracing for this portion of the structure due to the necessity to transmit vertical forces generated by the weight of the car, the lading, the rock-and-roll motion of the car, and vertical accelerations of the car from the car body bolster to the car's truck and wheel set. These forces must be transmitted through the casting and particularly the center plate portion thereof at the lowest stress possible and with a minimum of stress concentrations. Also this cast draft sill must remain in the same geometric relation with mechanical elements of the car as between their fabricated counterparts in the standard AAR (American Association of Railroads) draft sill arrangement.

Incorporation of a removably mountable center filler plate offers many advantages but necessitates an inventive consideration for it to be utilized at a unitary cast sill structure. Advantages of a removable center filler plate are its replaceability for repairing or rebuilding a railroad car and that a single casting can be fitted with center plates of a different bearing surface diameter as required by the particular application. Adapting a unitary cast center sill for use with a removable center filler plate requires that a rectangular pocket be provided in the center sill for mounting the center filler plate and the four sides of the pocket being elements of a four-sided column with the bottom element being the center plate which must be a rigid compression member. Vertical forces from the car are applied to the four sides of the column by a combination of structural members in the car body bolster and the center sill. These vertical forces are transmitted downward through the walls of this column and through the center filler plate to the truck bolster. The two sides of the center filler plate pocket that are transverse to the longitudinal axis of the car are formed by an inboard end wall and an internal wall of the casting and these are designed to carry high shear loads that result from rock-and-roll actions of the car. These shear loads undergo a full reversal during each cycle as the car rocks and these transverse walls resist the tendency of the center sill to be deformed to a "parallelogram" shape due to the load.

The sides of the draft gear pocket must carry the buff and draft force loads as well as vertical forces generated by the rock-and-roll motion. The two sides of the draft gear pocket that are arranged parallel to the longitudinal axis of the car are typically vertical webs of the Z-sections that comprise the center sill of the car. These vertical webs carry a major share of the buff and draft loads that are applied to the front and rear draft lugs. A problem with this portion of the prior structures is a tendency of the rear draft lugs to collapse inward from buff loads applied to them by the draft gear. Because of the incorporation of the center sill pocket, it is not possible to distribute these forces over the same load path as in previous cast draft sills without the center filler plate pocket. In these prior structures, these forces were transmitted into ribs behind the rear draft lugs and on into the side walls of the sill through shear. These ribs in prior draft sills extended in an inboard direction through the center plate and king pin portion of the structure and are substantially longer than ribs that could be utilized when providing a pocket for the described center plate. In overcoming this deficiency, the cast draft sill of this invention incorporates a U-shaped beam appropriately placed for distributing the loads and permitting formation of the center filler plate pocket.

In distributing loads from the inboard end of the prior art cast draft sills, they use a direct connection to the railroad car center sill without accounting for load distribution from the cast draft sill into the car center sill due to different tensile and compressive forces occurring at this juncture. To alleviate a condition of high strain sections meeting low strain sections of the structure, the present cast draft sill incorporates a transition element to join the cast draft sill in the car center sill. This transition element includes a fillet plate referred to as a "fish-tail plate" that is formed as a part of the casting and coupleable with the railroad car center sill in a telescopic fashion. The transition element also includes a lip around the sides and bottom of the casting to aid in load distribution.

SUMMARY OF THE INVENTION

An embodiment of the unitary cast draft sill structure of this invention includes a horizontal top wall with a pair of vertical side walls depending therefrom and a bottom portion with bottom flanges extending horizontally outward from the lower portion thereof. A vertical inboard end wall is at the inboard end portion of the structure with a transition element extending in the inboard direction therefrom. A center filler plate pocket is formed by the inboard end wall and an internal vertical wall so as to form a rectangular cavity opening to the bottom portion of the draft sill to accept and mount a center filler plate in welded relation. A draft gear pocket in the mid-portion of the structure has rear and forward draft lugs. On the outboard end portion of the cast draft sill a horizontal top striker is located above the coupler shank opening and a coupler carrier below to vertically support a coupler shank. A key slot is provided through the side walls for a coupler draft key.

One object of this invention is to provide a unitary cast draft sill overcoming the aforementioned disadvantages of the prior art devices.

Still, one other object of this invention is to provide a unitary cast draft sill that has provision for removably mounting a center filler plate in a pocket.

Still, another object of this invention is to provide a unitary cast draft sill having a transition element including a fish-tail plate for the distribution of forces from the cast draft sill into the railroad car center sill such that excessive stress levels and stress concentrations are avoided.

Another object of this invention is to provide a draft gear pocket including forward and rear draft lugs formed for the transmission of draft and buff forces and to the cast sill walls and the railroad car center sill walls in such a manner as to account for the pocket structure for mounting the center filler plate.

Various other objects, advantages, and features of this invention will become apparent to those skilled in the art from the following discussion, taken in conjunction with the accompanying drawings, in which:

Figure 1:
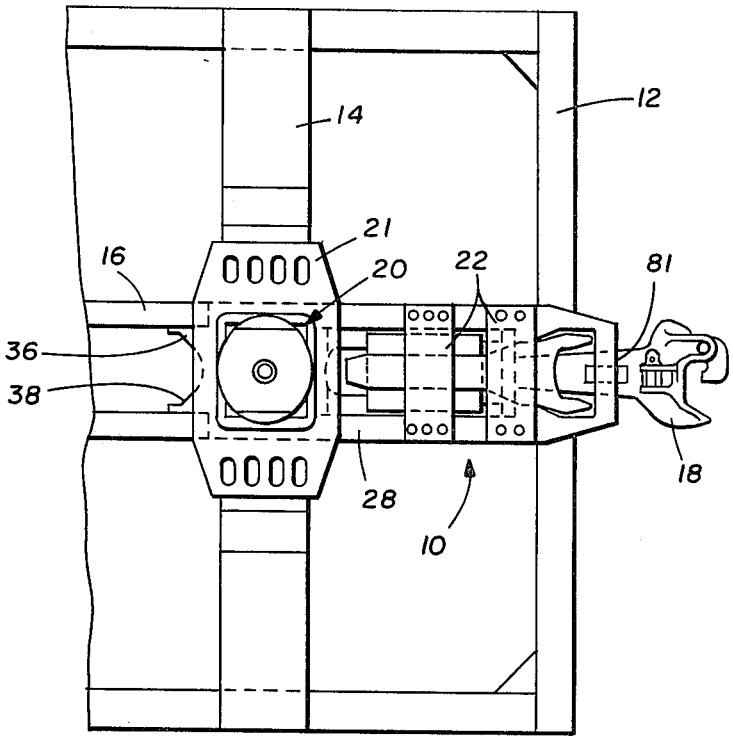
FIG. 1 is a bottom plan view of the underneath side of a railroad freight car having the cast draft sill of this invention mounted therein.
Figure 2:
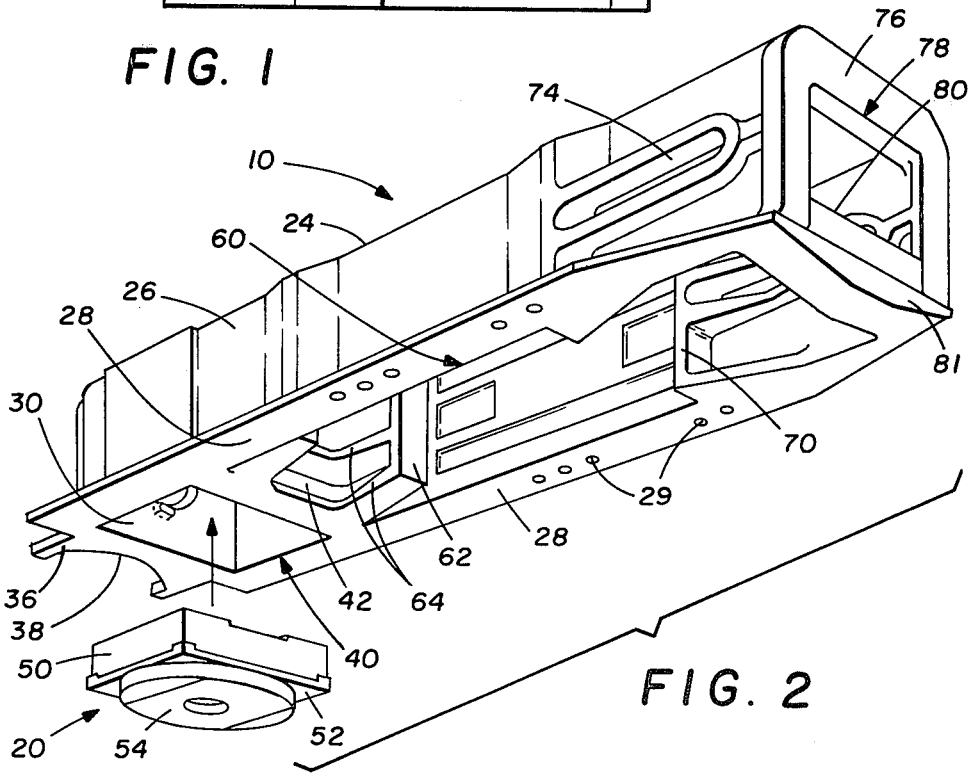
FIG. 2 is a perspective view of the cast draft sill and the associated center plate taken from the underneath side and from the outboard end thereof and with the center plate positioned in spaced relation below the center plate pocket.
Figure 3:
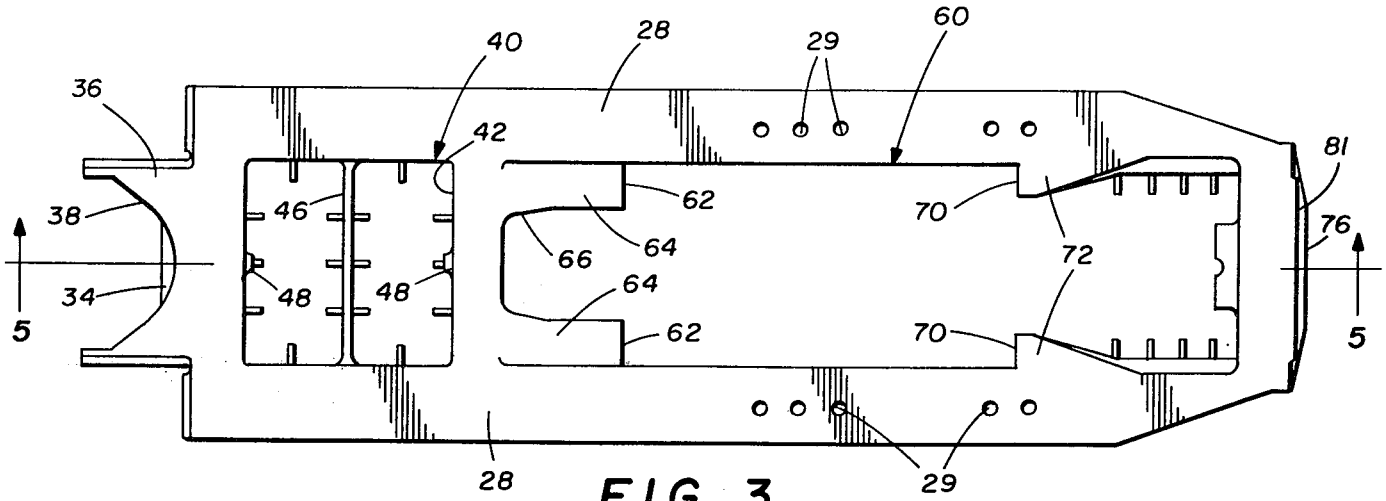
FIG. 3 is a bottom plan view of the cast draft sill.
Figure 4:
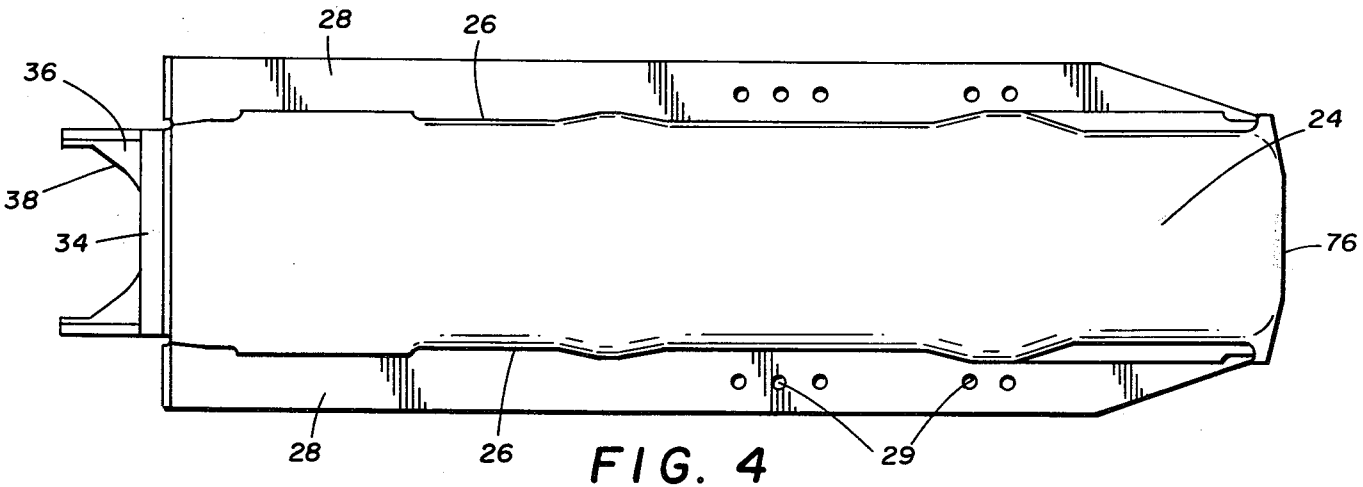
FIG. 4 is a top plan view of the cast draft sill.
Figure 5:
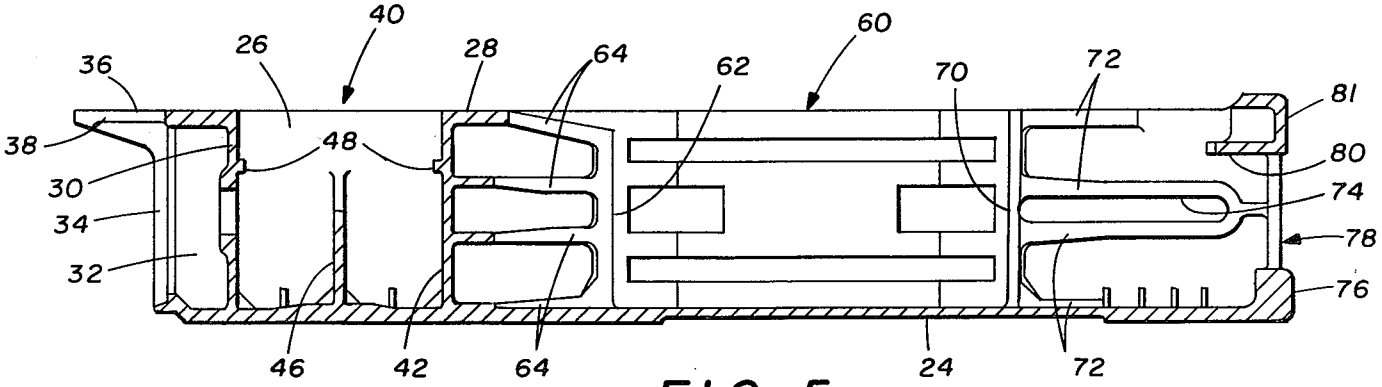
FIG. 5 is a longitudinal cross-sectional view of the cast draft sill taken through the longitudinal center thereof as indicated at 5—5 on FIG. 3.
Figure 7:
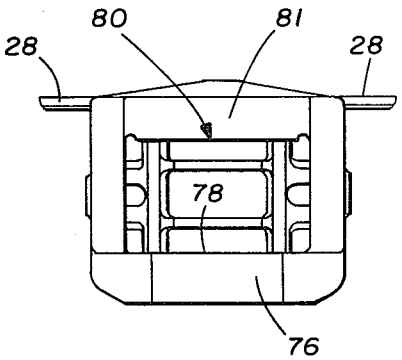
FIG. 7 is an outboard end view of the cast draft sill.

The following is a discussion and description preferred specific embodiments of the cast draft sill structure of this invention, such being made with reference to the drawings, whereupon the same reference numerals are used to indicate the same or similar parts and/or structure. It is to be understood that such discussion and description is not to unduly limit the scope of this invention.

DETAILED DESCRIPTION

FIG. 1 shows the cast draft sill of this invention, indicated generally at 10, mounted in the structure of a railroad freight car. In this mounted position the cast draft sill is secured to the end sill 12, the body bolster 14, and the center sill 16. The cast draft sill has the draft gear mounted within the draft gear pocket and the coupler 18 having its shank extending through the coupler shank opening at the outboard end thereof. A center filler plate, indicated generally at 20, is mounted in the center filler plate pocket of the cast draft sill in a welded relation. A sole plate 21 connects body bolster 14 over cast draft sill 10. The draft gear pocket of the cast draft sill has a pair of draft gear carrier members 22 mounted transversely thereto below the draft gear cushioning unit.

Referring to FIGS. 2–7, it can be easily seen that the cast draft sill of this invention is a unitary member with all the structural elements thereof combined in a single unit body. The cast draft sill 10 has a horizontal top wall 24 with vertical side walls 26 depending from the longitudinally disposed sides of the horizontal top wall 24. At the lower portion of vertical walls 26 cast draft sill 10 has a bottom portion including bottom flanges 28 extending horizontally outward from vertical side walls 26 along substantially their entire length. The bottom sides of the bottom flanges 28 define the bottom surface of the cast draft sill. A plurality of holes 29 in flanges 28 are provided for attaching draft gear carriers 22.

At the inboard end portion of the cast draft sill an inboard end wall 30 adjoins vertical side walls 26, horizontal top wall 24 and the bottom portion of the structure at bottom flanges 28. A transition element 32 extends in the inboard direction from inboard end wall 30 and includes a dimensionally reduced lip 34 extending from the side walls and top walls of the structure and the fillet or fish-tail plate 36 at the bottom of the structure in general horizontal alignment with bottom flanges 28. The lip structure 34 is sized dimensionally smaller transversely relative to the longitudinal axis of the cast draft sill than vertical side walls 26 and top wall 24 so the lip will fit within the connecting railroad car center sill 16 for welding thereto and transmitting of loads. Fish-tail plate 36 is comprised of a pair of facing horizontally disposed fillets extending between the inboard end of the transition element and a longitudinal extension horizontally aligned with the bottom flanges 28. Fish-tail plate 36 has a generally U-shaped opening 38 when seen from the bottom of the structure as in FIG. 3. The fillets forming the side portions of the fish-tail plate 36 function to transmit and distribute forces from the cast draft sill to sides of the center sill 16 when these fillet plates and lip 34 are welded to the railroad car center sill.

Immediately outboard of inboard end wall 30 is the center plate pocket indicated generally at 40. Center plate pocket 40 is defined between the outboard side of inboard end wall 30, adjoining facing portions of vertical side walls 26 and top wall 24, and the inboard side of an internal vertical wall 42. Internal vertical wall 42 extends between vertical side walls 26, top wall 24 and the bottom of the structure aligned with bottom flanges 28. Center plate pocket 40 defines a rectangular cavity in which a portion of an associated center plate 20 is mounted. Within center plate pocket 40, a transverse rib 46 extends between side walls 26 and downward from horizontal top wall 24 to a vertical mid-portion of the pocket. Also within the confines of the center plate pocket are a pair of positioning lugs 48 on the facing sides of inboard end wall 30 and internal vertical wall 42. Internal vertical wall 42 and inboard end wall 30 function as transverse spacer and shear plates within the cast draft structure to maintain a geometric rigidity of the draft sill and distribute loads when a railcar is undergoing rock-and-roll motion as described in the preceding.

Center filler plate 20 has upwardly extending sides 50 that fit within the internal sides of center filler plate pocket 40 in the bottom portion of the cast draft sill to locate and support the center plate structure. Recesses in the upper portion of two of these opposed sides 50 cooperatively engage positioning lugs 48 to insure correct orientation of the center plate. Center filler plate 20 has a flange portion 52 around the outer periphery of the bottom portion thereof which rests on the bottom surface of the cast draft sill. Flange portion 52 is welded to the cast draft sill for securing the center filler plate. The load bearing segment 54 of center filler plate 20 is generally circular and extends downward from flange 52 and has a king pin hole vertically through the center portion thereof as is well known in railroad car construction.

The draft gear pocket, indicated generally at 60, and associated draft lugs are located in the longitudinal mid-portion of the cast draft sill. In the inboard portion of draft gear pocket 60 are rear draft lugs 62 at each side of the draft sill. Rear draft lugs join to top wall 24 and side walls 26 and extending downwardly from top wall 24 nearly to the bottom of the structure. Support for rear draft lugs 62 is a plurality of ribs 64 located on the inboard side of these draft lugs. Ribs 64 extend between the inboard side of rear draft lugs 62, the interior of side walls 26 and the outboard side of the internal vertical wall 42. Ribs 64 comprise a curved beam that gives structural support to rear draft lugs 62, vertical side walls 26 and internal vertical wall 42. Also ribs 64 function to distribute force loads from buff loading of the draft gear into the sides and top of the cast draft sill. Four, (4), of these ribs are utilized with one of them at the top wall 24, another joining to the bottom portion of the structure and connecting at the vertical location of flanges 28, and two, (2), in a spaced relation in the vertical mid-portion of the structure. When seen from the bottom, as in FIG. 3, the interior perimeter of ribs 64 has a U-shaped appearance as indicated at their internal curvature 66.

In the outboard portion of the draft gear pocket 60, are forward draft lugs 70 in a vertical position extending inward from each side wall 26 and between top wall 24 and the bottom of flanges 28. Longitudinal support for forward draft lugs 70 is provided by a plurality of ribs 72 extending in the outboard direction from the outboard side of the draft lugs 70 to the side walls 26. Four, (4), of these ribs 72 are utilized with one being at top wall 24, another at flanges 28 and the remaining two, (2), in a spaced relation through the longitudinal mid-portion of the cast draft sill. The two, (2), ribs 72 in the mid-portion of the cast draft sill are located on upper and lower sides of the coupler key slot 74. Ribs 72 function to distribute draft force loads placed on forward draft lugs 70 into the side walls and top wall of the cast draft sill.

At the outboard end portion of cast draft sill 10, a horizontal striker plate 76 is provided across the horizontal upper end portion of the structure. A rectangular shank opening 78 is provided through the outboard end of the cast draft sill to accommodate the shank portion of railroar car coupler 18 as shown in FIG. 1. On the lower portion of shank opening 78, a coupler carrier 80 is provided for vertical support of the coupler shank. Draft sill lower end surface 81 is inwardly spaced from striker plate 76.

Figure 8:
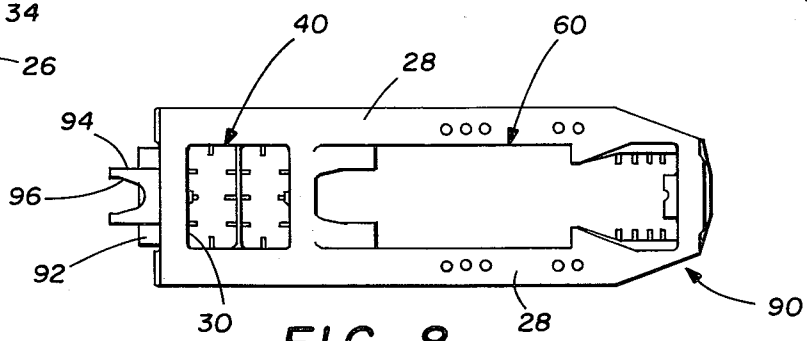
FIG. 8 is a bottom plan view of the cast draft sill in reduced size showing an alternate structural arrangement of the transition element portion of the structure wherein the fish-tail plate is dimensionally narrower than the distance between the side walls.
Figure 6:
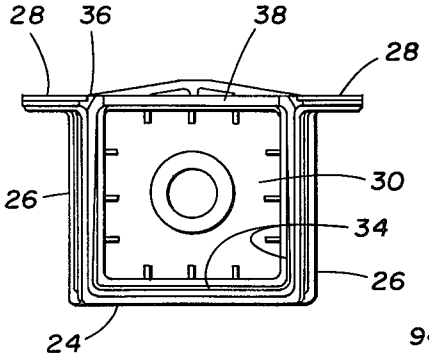
FIG. 6 is an inboard end view of the cast draft sill.

Referring to FIG. 8, such shows an alternate construction of the cast draft sill with such indicated generally at 90. The major portion of this alternate cast draft sill construction is the same as that described above, except for the transition element portion of the structure. Similar parts of this alternate draft sill 90 have the same identifying numerals as the other draft sill 10. In this construction of the cast draft sill, the transition element portion of the structure is different than that described above in order to accommodate a different form of railroad car center sill structure. The deviated portion of the transition element 92 extends from the side walls 26 and top wall 24 much as that described above. However, this transition element 92 has the lip thereof extending also across the bottom portion of the structure and the fish-tail plate 94 substantially narrower than the dimensional measurement between side walls 26. The fillet plates forming the horizontally disposed surfaces of fish-tail plate 94 cooperate to form a generally U-shaped opening 96 vertically through the fish-tail plate. Fish-tail plate 94 of this construction functionally performs the same task as the fish-tail plate described above in distributing loads from the cast draft sill to the railroad car center sill and reducing stress concentrations and distributing force loads.

In the foregoing, it has been seen that the unitary cast draft sill of this invention combines in one structure the load distributing features and a removably mountable center filler plate into an improved draft sill structure for railroad cars. The transition element distributes loads between the cast draft sill and the railroad car center sill by avoiding stress concentrations and uniformly spreading the load through the adjoining portions of the structures. The center plate pocket provides a receptacle for mounting of a separate center plate which has advantages over the prior art cast draft sills in replaceability, size selection and other selected design features. The draft pocket of the cast draft sill provides rear draft lugs that distribute buff forces from the draft gear to the side and top walls of the cast draft sill through the curved or U-shaped ribbed beam construction so as to prevent the tendency toward inward deflection of the side walls under buff loading. Inboard end wall and the internal vertical wall provide the load carrying members to prevent parallelogramming of the draft sill due to rock-and-roll motion of a railcar. The outboard end portion of the cast draft sill is provided with internal ribs for distributing loads from the front draft lugs, a striker plate, a coupler carrier and a coupler key slot for retaining the standard type E coupler. Generally the cast draft sill of this invention combines all of the desirable mechanical features of a cast draft sill with the convenience of a removably mountable center plate, the structurally desirable features of the transition element, and transverse shear load bearing members, and the rear draft lugs support members.

The embodiments of the invention in which an exclusive property or privilege is claimed are defined as follows:

1. A unitary cast draft sill to be welded to a center sill for a railroad car, comprising:

a horizontal top wall;

a pair of side walls depending from said top wall;

a bottom portion having bottom flanges extending horizontally outward from the lower end portion of the side walls and extending substantially the entire length of the cast draft sill;

a vertical inboard end wall joining said bottom portion, said side walls, and said horizontal top wall;

a transition element extending from the inboard side portion of said inboard end wall so as to telescopically enter adjacent portions of said railroad car center sill;

a center filler plate pocket formed by said inboard end wall, portions of said side walls, a portion of said top wall and an internal vertical wall spaced outboard from said inboard end wall and adjoining said side walls and said top wall so as to form a rectangular cavity with an opening at said bottom portion to accept and mount a center filler plate in welded relation;

rear draft lugs formed at the outboard side of said internal vertical wall and adjoining said side walls;

forward draft lugs formed on said side walls and extending between said bottom portion and said top wall; and on the outboard end portion of said cast draft sill a horizontal top striker above a coupler shank passage, a carrier to vertically support a coupler shank, and a key slot through said side walls for a coupler draft key.

2. The cast draft sill of claim 1, wherein, said transition element has a horizontally disposed fish-tail plate extending in the inboard direction from said inboard end wall, aligned generally horizontally with said cast draft sill bottom portion and having a generally U-shaped opening therethrough with the open end portion thereof at the inboard end of said cast draft sill.

3. The cast draft sill of claim 2, wherein:

said fish-tail plate has outer sides thereof substantially aligned with said vertical side walls at said inboard end wall and the bottom surface thereof substantially aligned with the bottom surface of said bottom flanges, so as to provide a smooth transition of forces between said railroad car center sill and said cast draft sill when said fish-tail plate is welded to said railroad car center sill; and said transition element includes side fillets extending from said inboard end wall at a location adjacent to said side walls and joining a top portion of said fish-tail plate at outer edge thereof.

4. The cast draft sill of claim 2, wherein:

said fish-tail plate has outer sides thereof substantially aligned with said vertical side walls at said inboard end wall and the bottom surface thereof substantially aligned with bottom surfaces of said bottom flanges so as to provide a smooth transition of forces between the railroad car center sill and the cast draft sill when said fish-tail plate is welded to said railroad car center sill; and said transition element additionally includes a telescopic lip extending in the inboard direction around the inboard side of said inboard end wall and located in an inwardly stepped relation, relative to the longitudinal axis of said cast draft sill, to said vertical side walls and said top wall with portions of said lip extending substantially the entire length of said fish-tail plate.

5. The cast draft sill of claim 4, wherein:

said rear draft lugs have a pair of vertically disposed buff load carrying members spaced outboard of said internal vertical wall on opposed sides of said cast draft sill joining said top wall and said vertical side walls; and said rear draft lugs having a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall.

6. The cast draft sill of claim 4, wherein:

said center filler plate pocket has a transverse rib formed within a mid-portion of said pocket and joining said top wall and, said sidewalls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

7. The cast draft sill of claim 4, wherein:

said rear draft lugs have a pair of vertically disposed buff load carrying members spaced outboard of said internal vertical wall on opposed sides of said cast draft sill joining said top wall and said vertical side walls;

said rear draft lugs have a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

said center filler plate pocket has a transverse rib formed within a mid-portion of said pocket and joining said top wall and, said side walls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

8. The cast draft sill of claim 2, wherein:

said fish-tail plate has outer sides thereof spaced substantially inward of and parallel to said side walls at said inboard end wall and having the bottom surface thereof substantially aligned with the bottom surfaces of said bottom flanges so as to provide a smooth transition of forces between the railroad car center sill and said cast draft sill when said fish-tail plate is welded to said railroad car center sill; and said transition element also includes side fillets extending from the top of side fish-tail plate to said inboard end wall at the inboard side thereof.

9. The cast draft sill of claim 2, wherein:

said fish-tail plate has outer sides thereof spaced substantially inward of and parallel to said side walls at said inboard end wall and having the bottom surface thereof substantially aligned with the bottom surfaces of said bottom flanges so as to provide a smooth transition of forces between the railroad car center sill and said cast draft sill when said fish-tail plate is welded to said railroad car center sill; and said transition element additionally includes a telescopic lip extending in the inboard direction around the inboard side of said inboard end wall and located in an inwardly stepped relation, relative to the longitudinal axis of said cast draft sill, to said vertical side wall and said top wall with portions of said lip extending substantially the entire length of said fish-tail plate outer sides.

10. The cast draft sill of claim 9, wherein:

said rear draft lugs have a pair of vertically disposed buff load carrying members spaced outboard of said internal vertical wall on opposed sides of said cast draft sill joining said top wall and said vertical side walls; and said rear draft lugs having a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall.

11. The cast draft sill of claim 9, wherein:

said center filler plate pocket has a transverse rib formed within a mid-portion of said pocket and joining said top wall and, said sidewalls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

12. The cast draft sill of claim 9, wherein:

said rear draft lugs have a pair of vertically disposed buff load carrying members spaced outboard of said internal vertical wall on opposed sides of said cast draft sill joining said top wall and said vertical side walls;

said rear draft lugs have a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

said center filler plate pocket has a transverse rib formed within a mid-portion of said pocket and joining said top wall and, said side walls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

13. The cast draft sill of claim 2, wherein:

said rear draft lugs have a pair of vertically disposed buff load carrying members spaced outboard of said internal vertical wall on opposed sides of said cast draft sill joining said top wall and said vertical side walls; and said rear draft lugs having a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall.

14. The cast draft sill of claim 2, wherein:

said center filler plate pocket has a transverse rib formed within a mid-portion of said pocket and joining said top wall and, said sidewalls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

15. The cast draft sill of claim 2, wherein:

said rear draft lugs have a pair of vertically disposed buff load carrying members spaced outboard of said internal vertical wall on opposed sides of said cast draft sill joining said top wall and said vertical side walls;

said rear shaft lugs have a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

said center filler plate pocket has a transverse rib formed within a mid-portion of said pocket and joining said top wall and, said side walls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

16. The cast draft sill of claim 1, wherein:

said rear draft lugs have a pair of vertically disposed buff load carrying members spaced outboard of said internal vertical wall on opposed sides of said cast draft sill joining said top wall and said vertical side walls; and said rear draft lugs having a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall.

17. The cast draft sill of claim 1, wherein:

said center filler plate pocket has a transverse rib formed within a mid-portion of said pocket and joining said top wall and, said sidewalls and extending downward from said top wall to a mid-portion of said pocket; and said internal vertical wall and said inboard end wall form load carrying and distributing members that are operable to distribute unbalanced vertical forces acting on said cast draft sill through a center filler plate when a railroad car having the cast draft sill is undergoing rock and roll motion.

18. The cast draft sill of claim 1, wherein:

said rear draft lugs have a pair of vertically disposed buff load carrying members spaced outboard of said internal vertical wall on opposed sides of said cast draft sill joining said top wall and said vertical side walls;

said rear draft lugs have a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

said center filler plate pocket has a transverse rib formed within a mid-portion of said pocket and joining said top wall and, said side walls and extending downward from said top wall to a mid-portion of said pocket; and said internal vertical wall and said inboard end wall from load carrying and distributing members that are operable to distribute unbalanced vertical forces acting on said cast draft sill through a center filler plate when a railroad car having the cast draft sill is undergoing rock and roll motion.

19. A unitary cast draft sill to be welded to a center sill for a railroad car, comprising:

a horizontal top wall;

a pair of side walls depending from said top wall;

a bottom portion having bottom flanges extending horizontally outward from the lower end portion of the side walls and extending substantially the entire length of the cast draft sill;

a vertical inboard end wall joining said bottom portion, said side walls, and said horizontal top wall;

a transition element extending from the inboard side portion of said inboard end wall so as to telescopically enter adjacent portions of said railroad car center sill; and element has a horizontally disposed fish-tail plate extending in the inboard direction from said inboard end wall, aligned generally horizontally with said cast draft sill bottom portion and having a generally U-shaped opening therethrough with the open end portion thereof at the inboard end of said cast draft sill;

a center filler plate pocket formed by said inboard end wall, portions of said side walls, a portion of said top wall and an internal vertical wall spaced outboard from said inboard end wall and adjoining said side walls and said top wall so as to form a rectangular cavity with an opening at said bottom portion to accept and mount a center filler plate in welded relation; said internal vertical wall and said inboard end wall form load carrying and distributing members that are operable to distribute unbalanced vertical forces acting on said cast draft sill through a center filler plate when a railroad car having the cast draft sill is undergoing rock and roll motion;

said center filler plate pocket has a transverse rib formed within a mid-portion of said center filler plate pocket and joining said top wall and, said side walls and extending downward from said top wall to a mid-portion of said pocket;

rear draft lugs having a pair of vertically disposed buff load carrying members spaced outboard of said internal vertical walls on opposed sides of said cast draft sill joining said top wall and said vertical side walls; and a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

forward draft lugs formed on said side walls and extending between said bottom portion and said top wall; and on the outboard end portion of said cast draft sill a horizontal top striker above a coupler shank passage, a carrier to vertically support a coupler shank, and a key slot through said side walls for a coupler draft key.

20. A unitary cast draft sill to be welded to a center sill for a railroad car, comprising:

a horizontal top wall;

a pair of side walls depending from said top wall;

a bottom portion having bottom flanges extending horizontally outward from the lower end portion of the side walls and extending substantially the entire length of the cast draft sill;

a vertical inboard end wall joining said bottom portion, said side walls, and said horizontal top wall;

a transition element extending from the inboard side portion of said inboard end wall so as to telescopically enter adjacent portions of said railroad car center sill; and element has a horizontally disposed fish-tail plate extending in the inboard direction from said inboard end wall, aligned generally horizontally with said cast draft sill bottom portion and having a generally U-shaped opening therethrough with the open end portion thereof at the inboard end of said cast draft sill; wherein said fish-tail plate has outer sides thereof spaced substantially inward of and parallel to said side walls at said inboard end wall and having the bottom surface thereof substantially aligned with the bottom surfaces of said bottom flanges so as to provide a smooth transition of forces between the railroad car center sill and said cast draft sill when said fish-tail plate is welded to said railroad car center sill;

a center filler plate pocket formed by said inboard end wall, portions of said side walls, a portion of said top wall and an internal vertical wall spaced outboard from said inboard end wall and adjoining said side walls and said top wall so as to form a rectangular cavity with an opening at said bottom portion to accept and mount a center filler plate in welded relation; said internal vertical wall and said inboard end wall form load carrying and distributing members that are operable to distribute unbalanced vertical forces acting on said cast draft sill through a center filler plate when a railroad car having the cast draft sill is undergoing rock and roll motion;

said center filler plate pocket has a transverse rib formed within a mid-portion of said center filler plate pocket and joining said top wall and, said side walls and extending downward from said top wall to a mid-portion of said pocket;

rear draft lugs having a pair of vertically disposed buff load carrying members spaced outboard of said internal vertical wall on opposed sides of said cast draft sill joining said top wall and said vertical side walls; and a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

forward draft lugs formed on said side walls and extending between said bottom portion and said top wall; and on the outboard end portion of said cast draft sill a horizontal top striker above a coupler shank passage, a carrier to vertically support a coupler shank, and a key slot through said side walls for a coupler draft key.

21. A unitary cast draft sill to be welded to a center sill for a railroad car, comprising:

a horizontal top wall;

a pair of side walls depending from said top wall;

a bottom portion having bottom flanges extending horizontally outward from the lower end portion of the side walls and extending substantially the entire length of the cast draft sill;

a vertical inboard end wall joining said bottom portion, said side walls, and said horizontal top wall;

a transition element extending from the inboard side portion of said inboard end wall so as to telescopically enter adjacent portions of said railroad car center sill; and element has a horizontally disposed fish-tail plate extending in the inboard direction from said inboard end wall, aligned generally horizontally with said cast draft sill bottom portion and having a generally U-shaped opening therethrough with the open end portion thereof at the inboard end of said cast draft sill; wherein said fish-tail plate has outer sides thereof spaced substantially inward of and parallel to said side walls at said inboard end wall and having the bottom surface thereof substantially aligned with the bottom surfaces of said bottom flanges so as to provide a smooth transition of forces between the railroad car center sill and said cast draft sill when said fish-tail plate is welded to said railroad car center sill;

said transition element additionally includes a telescopic lip extending in the inboard direction around the inboard side of said inboard end wall and located in an inwardly stepped relation, relative to the longitudinal axis of said cast draft sill, to said vertical side wall and said top wall with portions of said lip extending substantially the entire length of said fish-tail plate outer sides;

a center filler plate pocket formed by said inboard end wall, portions of said side walls, a portion of said top wall and an internal vertical wall spaced outboard from said inboard end wall and adjoining said side walls and said top wall so as to form a rectangular cavity with an opening at said bottom portion to accept and mount a center filler plate in welded relation; said internal vertical wall and said inboard end wall form load carrying and distributing members that are operable to distribute unbalanced vertical forces acting on said cast draft sill through a center filler plate when a railroad car having the cast draft sill is undergoing rock and roll motion;

said center filler plate pocket has a transverse rib formed within a mid-portion of said center filler plate pocket and joining said top wall and, said side walls and extending downward from said top wall to a mid-portion of said pocket;

rear draft lugs having a pair of vertically disposed buff load carrying members spaced outboard of said internal vertical wall on opposed sides of said cast draft sill joining said top wall and said vertical side walls; and a plurality of generally U-shaped ribs providing buff load support and preventing inward deflection of said side walls due to buff loading of said rear draft lugs, said ribs having end portions joining inboard sides of said buff load carrying members, side portions joining innerside portions of said side walls, and closed end portions joining the outboard side of said internal vertical wall, said ribs defining a load distributing structure operable to distribute buff forces from a draft gear and said buff load carrying members into said top wall, said side walls and said internal vertical wall;

forward draft lugs formed on said side walls and extending between said bottom portion and said top wall; and on the outboard end portion of said cast draft sill a horizontal top striker above a coupler shank passage, a carrier to vertically support a coupler shank, and a key slot through said side walls for a coupler draft key.

22. In a railroad car having a center sill a unitary cast draft sill welded to the center sill, wherein the cast draft sill comprises:

a horizontal top wall;

a pair of side walls depending from said top wall;

a bottom portion having bottom flanges extending horizontally outward from the lower end portion of the side walls and extending substantially the entire length of the cast draft sill;

a vertical inboard end wall joining said bottom portion, said side walls, and said horizontal top wall;

a transition element extending from the inboard side portion of said inboard end wall so as to telescopically enter adjacent portions of said railroad car center sill;

a center filler plate pocket formed by said inboard end wall, portions of said side walls, a portion of said top wall and an internal vertical wall spaced outboard from said inboard end wall and adjoining said side walls and said top wall so as to form a rectangular cavity with an opening at said bottom portion to accept and mount a center filler plate in welded relation;

rear draft lugs formed at the outboard side of said internal vertical wall and adjoining said side walls;

forward draft lugs formed on said side walls and extending between said bottom portion and said top wall; and on the outboard end portion of said cast draft sill a horizontal top striker above a coupler shank passage, a carrier to vertically support a coupler shank, and a key slot through said side walls for a coupler draft key.

* * * * *